US008331593B2

(12) United States Patent
Slemming et al.

(10) Patent No.: US 8,331,593 B2
(45) Date of Patent: Dec. 11, 2012

(54) HEARING AID WITH A REMOVABLY CONNECTED ELONGATE MEMBER

(75) Inventors: Jesper Koj Slemming, Bronshoj (DK); Henrik Nielsen, Roskilde (DK)

(73) Assignee: GN ReSound A/S, Ballerup (DK)

( * ) Notice: Subject to any disclaimer, the term of this patent is extended or adjusted under 35 U.S.C. 154(b) by 440 days.

(21) Appl. No.: 12/278,241

(22) PCT Filed: Jun. 22, 2007

(86) PCT No.: PCT/DK2007/000305

§ 371 (c)(1),
(2), (4) Date: Mar. 4, 2009

(87) PCT Pub. No.: WO2007/147415

PCT Pub. Date: Dec. 27, 2007

(65) Prior Publication Data

US 2009/0323993 A1 Dec. 31, 2009

Related U.S. Application Data

(60) Provisional application No. 60/816,246, filed on Jun. 23, 2006.

(30) Foreign Application Priority Data

Jun. 23, 2006 (DK) ..... 2006 00853

(51) Int. Cl.
*H04R 25/02* (2006.01)
*H04R 25/00* (2006.01)

(52) U.S. Cl. ..... 381/318; 381/380

(58) Field of Classification Search ..... 381/318, 381/322, 313, 330, 328
See application file for complete search history.

(56) References Cited

U.S. PATENT DOCUMENTS 3,783,201 A * 1/1974 Weiss et al. ..... 381/324
4,553,627 A 11/1985 Gastmeier et al.
5,048,090 A * 9/1991 Geers ..... 381/328
5,201,006 A * 4/1993 Weinrich ..... 381/318
5,403,262 A 4/1995 Gooch (Continued)

FOREIGN PATENT DOCUMENTS

CH 673551 A5 2/1984

(Continued)

OTHER PUBLICATIONS

Office Action dated Jan. 11, 2012 for CN Application No. 200780030352.X.

(Continued)

*Primary Examiner* — Yuwen Pan
*Assistant Examiner* — Phan Le
(74) *Attorney, Agent, or Firm* — Vista IP Law Group, LLP

(57) ABSTRACT

The present invention relates to a new type of hearing aid with a housing that is adapted for positioning in the ear canal of a user and attached to an elongate member that is adapted for positioning in the pinna outside the ear canal of the user. The elongate member is adapted for removable interconnection with the hearing aid the housing of which is adapted for positioning in the ear canal of a user and accommodates a signal processor for processing an audio signal into an audio signal compensating a hearing loss and a receiver that is connected to an output of the signal processor for converting the processed compensated audio signal into a sound signal.

29 Claims, 16 Drawing Sheets

U.S. PATENT DOCUMENTS

| | | | | |
|---|---|---|---|---|
| 5,619,580 | A | 4/1997 | Hansen | |
| 5,654,530 | A | 8/1997 | Sauer et al. | |
| 5,680,467 | A | 10/1997 | Hansen | |
| 5,889,874 | A | 3/1999 | Schmitt et al. | |
| 6,493,454 | B1 * | 12/2002 | Loi et al. | 381/328 |
| 6,498,858 | B2 | 12/2002 | Kates | |
| 6,532,294 | B1 | 3/2003 | Rdell | |
| 6,704,423 | B2 | 3/2004 | Anderson et al. | |
| 6,940,989 | B1 | 9/2005 | Shennib et al. | |
| 7,130,437 | B2 | 10/2006 | Stonikas et al. | |
| 7,424,124 | B2 | 9/2008 | Shennib et al. | |
| 7,899,200 | B2 * | 3/2011 | Karamuk et al. | 381/328 |
| 2001/0043707 | A1 | 11/2001 | Leedom | |
| 2001/0051776 | A1 | 12/2001 | Lenhardt | |
| 2004/0047483 | A1 | 3/2004 | Bauman | |
| 2004/0096075 | A1 * | 5/2004 | Kuhlmann et al. | 381/312 |
| 2004/0131200 | A1 | 7/2004 | Davis | |
| 2004/0258264 | A1 * | 12/2004 | Jorgensen et al. | 381/328 |
| 2005/0078843 | A1 | 4/2005 | Bauman | |
| 2005/0190940 | A1 | 9/2005 | Ach-Kowalewski et al. | |
| 2006/0050914 | A1 | 3/2006 | Urso et al. | |
| 2006/0147072 | A1 | 7/2006 | Sodoma | |
| 2006/0239483 | A1 | 10/2006 | Orts et al. | |
| 2007/0036374 | A1 * | 2/2007 | Bauman et al. | 381/312 |

FOREIGN PATENT DOCUMENTS

| | | | |
|---|---|---|---|
| CN | 1124003 | A | 6/1996 |
| DE | 8328154 | U1 | 2/1984 |
| DE | 29801567 | U1 | 4/1998 |
| DE | 19706306 | C1 | 10/1998 |
| DE | 29718483 | U1 | 2/1999 |
| DE | 29718503 | U1 | 4/1999 |
| DE | 29916891 | U1 | 3/2000 |
| EP | 0368125 | A2 | 5/1990 |
| EP | 1448014 | A1 | 8/2004 |
| EP | 1594340 | A | 11/2005 |
| EP | 1653776 | | 5/2006 |
| GB | 2134689 | A | 8/1984 |
| JP | 5-199590 | A | 8/1993 |
| WO | 9621334 | | 7/1996 |
| WO | 9734443 | | 9/1997 |
| WO | 9851125 | A | 11/1998 |
| WO | 0076271 | A | 12/2000 |
| WO | 0108443 | A2 | 2/2001 |
| WO | 0128289 | A1 | 4/2001 |
| WO | 0203757 | A1 | 1/2002 |
| WO | 02052890 | A1 | 7/2002 |
| WO | 2004010734 | A1 | 1/2004 |
| WO | 2004036953 | | 4/2004 |
| WO | 2007147415 | A1 | 12/2007 |

OTHER PUBLICATIONS

Office Action dated Mar. 15, 2010 for EP Application No. 07722683.5.

Written Opinion of the International Search Authority for PCT/DK2007/000305, (dated 2010).

International Preliminary Report on Patentability and Written Opinion of the International Search Authority for PCT/DK2007/000307, (dated 2010).

International Preliminary Report on Patentability and Written Opinion of the International Search Authority for PCT/DK2007/000306, (dated 2010).

Pawel J. Jastreboff, "Tinnitus Habituation Therapy (THT) and Tinnitus Retraining Therapy (TRT)", In Tyler RS, ed. Handbook of Tinnitus. San Diego: Singular Publishing; 2000:357-375.

Luca Del Bo et al, "Using Open-Ear Hearing Aids in Tinnitus Theraphy", Hearing Review, Aug. 2006.

Non-Final Office Action dated Oct. 17, 2011, for U.S. Appl. No. 12/299,047.

Final Office Action dated Apr. 19, 2012, for U.S. Appl. No. 12/299,047.

Non-Final Office Action dated Aug. 16, 2011, for U.S. Appl. No. 12/186,370.

Final Office Action dated Jan. 18, 2012, for U.S. Appl. No. 12/186,370.

Non-Final Office Action dated Oct. 26, 2011, for U.S. Appl. No. 12/299,101.

Final Office Action dated Jun. 21, 2012, for U.S. Appl. No. 12/299,101.

Notice of Allowance and Fee(s) Due dated Aug. 21, 2012, for U.S. Appl. No. 12/186,370.

Machine English Translation of the Abstract for JP Patent No. 05-199590 A, Aug. 6, 1993.

Office Action dated Jul. 10, 2012 for JP Patent Application No. 2009-515705.

English Translation of the Office Action dated Jul. 10, 2012 for JP Patent Application No. 2009-515705.

Office Action dated Jul. 10, 2012 for JP Patent Application No. 2009-515706.

English Translation of the Office Action dated Jul. 10, 2012 for JP Patent Application No. 2009-515706.

Office Action dated Jul. 10, 2012 for JP Patent Application No. 2009-515707.

English Translation of the Office Action dated Jul. 10, 2012 for JP Patent Application No. 2009-515707.

Advisory Action dated Sep. 4, 2012, for U.S. Appl. No. 12/299,047.

Final Office Action dated Sep. 5, 2012, for U.S. Appl. No. 12/299,101.

Notice of Allowance and Fees Due dated Oct. 4, 2012, for U.S. Appl. No. 12/186,370.

* cited by examiner

A

B

HEARING AID WITH A REMOVABLY CONNECTED ELONGATE MEMBER

RELATED APPLICATION DATA

This application is the national stage of International Application No. PCT/DK2007/000305, filed on Jun. 22, 2007, which claims the benefit of U.S. Provisional Patent Application No. 60/816,246, filed on Jun. 23, 2006, and Danish Patent Application No. PA 2006 00853, filed on Jun. 23, 2006, the entire disclosures of all of which are expressly incorporated by reference herein.

The present invention relates to a new type of hearing aid with a housing that is adapted for positioning in the ear canal of a user and attached to an elongate member that is adapted for positioning in the pinna outside the ear canal of the user.

A conventional in the ear (ITE) or completely-in-the-canal (CIC) hearing aid has a housing that is custom made to individually fit the user's ear canal. The hearing aid components, e.g. electronics, microphone, receiver, battery, etc., are contained in the housing which is closed by a faceplate at the end pointing away from the ear canal. In order to reduce occlusion, a so-called vent, i.e. a ventilation channel, is provided for communication between an opening in the faceplate and the user's ear canal. The vent may be drilled through the housing or shell, or a pipe or tube extending within the hearing aid and connecting an opening in the faceplate with an opening at the opposite end of the housing may constitute the vent. The effectiveness of the vent is increased by increasing the cross-section and decreasing the length of the vent channel.

Behind-the-ear (BTE) hearing aids in which a sound tube conducts sound generated by the receiver of the hearing aid into the ear canal are also well known in the art. In order to position the sound tube securely and comfortably in the ear canal, an earpiece is provided for insertion into the ear canal of the user.

Typically, the ITE or CIC housing or the BTE earpiece is individually custom manufactured to fit precisely in the ear canal of the user without causing pain to the user while still retaining the housing or earpiece securely in place in the ear canal preventing the earpiece from falling out of the ear irrespective of movements of the user, such as chewing or yawning, and also avoiding acoustical feedback generating unpleasant and annoying whistling or howling. The custom made earpiece adds to the cost of the hearing aid and the time needed to fit the hearing aid.

Typically, customized hearing aids are made from solid materials to secure retention and tightness. These hearing aids are placed completely or partially in the ear canal. Since the walls of the ear canal are moving when the jaws move for instance when chewing, the placement of such solid hearing aids in the ear canal can be associated with discomfort for the user.

Several approaches to eliminate this discomfort have been tried, one such approach is to make the canal portion of the device in a soft material, e.g. as disclosed in WO 02/03757 A1. Such devices are complicated to manufacture and will only offer limited venting.

In WO 2004/010734, a canal hearing device is disclosed having a dual acoustic seal system for preventing feedback while minimizing occlusion effects. The two-part device comprises a main module and an elongated tubular insert for conducting sound to the eardrum and sealing within the bony region of the ear canal. The main module is positioned in the cartilaginous portion of the ear canal. The tubular insert comprises a sound conduction tube and a cylindrically hollow primary seal medially positioned in the bony region. The device also comprises a secondary seal laterally positioned in the cartilaginous region.

WO 01/08443 discloses a one-size-fits-all hearing aid, which is adapted to fit into either ear of an ear canal of a user to a depth proximal to the tympanic membrane. The hearing aid is comprised of two half shells joined together to house the hearing aid components. The joined shells secure a flexible tip at the distal end of the shell.

It is an object of the present invention to provide a hearing aid wherein a part of the hearing aid can be securely and comfortably positioned and retained inside the ear canal of a user similar to the housing of a CIC hearing aid.

It is another object of the present invention to provide the hearing aid in standard sizes eliminating the need for customization.

According to an aspect of the present invention, the above and other objects are fulfilled by a hearing aid with a housing for accommodation of electronic components and adapted to be positioned in the ear canal of a user and having an output port for emission of sound towards the eardrum of the user when inserted in the ear canal. The housing is attached to an elongate member adapted for positioning in the pinna and outside the ear canal of the user.

The elongate member has a first end attached to the housing and an opposite second end.

According to another aspect of the invention, an elongate member is provided that is adapted for removable interconnection with a hearing aid having a housing having a housing that is adapted for positioning in the ear canal of a user and that accommodates a signal processor for processing an audio signal into an audio signal compensating a hearing loss, and a receiver that is connected to an output of the signal processor for converting the processed compensated audio signal into a sound signal.

The elongate member may be attached to a connector that is adapted for removable attachment to a hearing aid. The connector may fit mechanically to the surface of the hearing aid housing thereby closing the housing when the elongate member is connected to the hearing aid. The connector may for example comprise a battery door that is adapted for removable attachment to the hearing aid housing as described in more detail below.

The elongate member may further comprise a microphone.

The elongate member may have a first end and a second end that is adapted for positioning of the microphone. The elongate member may further accommodate a signal line for transmission of signals from the microphone, and the hearing aid housing may comprise a connector for making electrical contact with the signal line in the elongate member when the connector of the elongate member, e.g. a battery door, is attached to the housing.

In accordance with hearing aid terminology, the housing is denoted an open housing, when the housing does not obstruct the ear canal when it is positioned in its intended operational position in the ear canal. There will be a passageway between a part of the ear canal wall and a part of the housing so that sound waves may escape from behind the housing between the ear drum and the housing through the passageway to the surroundings of the user. In this way, the occlusion effect is diminished and preferably substantially eliminated.

The first thing that people being fitted with a hearing aid note is usually the change of their voice. They typically describe the sound of their own voice in one of the following terms: "My voice echoes", "My voice sounds hollow" or "I sound like I'm talking in a barrel". Their altered perception of their own voice is mainly due to occlusion of the ear canal by the housing or earpiece.

Sounds originating from the vocal tract (throat and mouth) are transmitted into the ear canal through the cartilaginous tissue between these cavities and the outer portion of the ear canal.

When nothing is positioned in the ear canal, most of this predominantly low frequency sound simply escapes from the ear canal. However, when the ear canal is blocked these bone-conducted sounds cannot escape from the ear canal. The result is a build-up of high sound pressure levels in the residual ear canal volume. This increase in low frequency sound pressure is audible and will cause them to hear their own voice as loud and boomy. Change in perception of own voice is the most dominant occlusion related complaint, but not the only one. Other occlusion related problems include too much amplification at low frequencies for hearing aid users with good low frequency hearing, reduced speech intelligibility, poorer localization, physical discomfort and increased risk of external ear irritation and infection. Hearing aid users do not adapt to occlusion and the occlusion effect has been cited by as many as 27% of hearing aid wearers as a reason for dissatisfaction with their hearing aids. This emphasizes the need for alleviating or, even better, eliminating the occlusion effect.

A hearing aid comprises a microphone for converting sound into an audio signal, a signal processor for processing the audio signal into an audio signal compensating a hearing loss, and a loudspeaker that is connected to an output of the signal processor for converting the processed compensated audio signal into a sound signal. Further, the hearing aid comprises a battery for power supply of the electric components of the hearing aid.

In accordance with hearing aid terminology, the loudspeaker is also denoted a receiver throughout the present specification.

In one embodiment of the present invention, the housing accommodates the above-mentioned hearing aid components including the microphone in a way similar to the housing of a CIC hearing aid. In another embodiment, the elongate member accommodates the microphone at its second end and the housing accommodates the other components, and signal conductors extend within the elongate member for electrical interconnection of the microphone with other components in the hearing aid housing.

The housing according to the present invention is preferably manufactured in a number of standard sizes to fit the human anatomy of the ear canal of most users. In this way, the manufacturing cost is lowered as compared to the manufacturing cost of customized housings.

The elongate member according to the present invention is preferably manufactured in a number of standard sizes to fit the human anatomy of the pinna of most users. In this way, the manufacturing cost is lowered as compared to the manufacturing cost of customized elongate members.

In a preferred embodiment of the invention, the elongate member is removably interconnected with the housing so that a large number of different models of the hearing aid may be provided by combining elongate members of different standard sizes with housings of different standard sizes.

The housing may comprise a battery door providing access to a battery compartment. The elongate member may be attached to the battery door and the battery door may be removably attached to the housing with a connector for removal of the elongate member from the housing together with the battery door.

The connector may further be adapted for making electrical contact with a signal line in the elongate member when the battery door is attached to the housing.

In one embodiment, the elongate member is adapted to be positioned in the pinna of the user around the circumference of the conchae abutting the antihelix and at least partly covered by the antihelix for retainment of its position.

The elongate member may be preformed during manufacture, preferably into an arched shape with a curvature slightly larger than the curvature of the antihelix, for easy fitting of the elongate member into its intended position in the pinna.

The elongate member may be resilient for assisting in retaining the housing in the ear canal of the user so that the housing remains securely in place in the ear canal without falling out of the ear irrespective of movements of the user, such as chewing or yawning. Retention is provided without causing pain to the user.

The elongate member may further be adapted to abut part of the concha at the antitragus when the housing has been inserted in the ear canal thereby applying a force to the housing towards the ear canal retaining the housing in a position in which the housing is pressed against an anatomical feature within the ear canal.

Retention of the hearing aid in the proper place is important. Jaw movements can exert outward forces on the canal portion of the hearing aid. In an embodiment of the present invention, the elongate member has sufficient resilience to counteract this force and sufficiently securing the hearing aid from outward motion.

Preferably, the elongate member is resilient in a direction perpendicular to its longitudinal extension thereby providing further capability of retention of the housing in the ear canal of the user. During positioning of the housing in its intended position in the ear canal of the user, the transverse resilience of the elongate member facilitates insertion of the housing into the ear canal of the user.

Preferably, the elongate member is adapted to abut the antihelix and extend at least to the inferior crus of the antihelix when the housing is positioned in the ear canal of the user.

More preferred the elongate member is adapted for positioning of the second end at the cimba concha below the triangular fossa of the ear of the user when the housing is positioned in the ear canal of the user.

The elongate member may be adapted for accommodation of a microphone at the second end. The elongate member may have a larger cross-section at the second end accommodating the microphone than a remaining part of the elongate member extending therefrom and towards the first end.

Positioning of the microphone of the hearing aid at the second end of the elongate member provides a large distance between the microphone and the receiver thereby minimizing feedback.

Feedback limits the maximum gain available to the user of the hearing aid. Feedback refers to the amplified sound returning to the hearing aid microphone from the hearing aid output port mainly through the passageway between the housing and the ear canal wall. Oscillation arises when the attenuation provided by the feedback path is smaller than the hearing aid gain. A large distance between the microphone and the receiver alleviates this problem.

As further described below, electronic feedback suppression may also be provided in the hearing aid according to the invention.

The elongate member may accommodate further electrical hearing aid components.

In an embodiment with a microphone at the second end of the elongate member, the elongate member is preferably substantially rigid in the direction of its longitudinal extension so that electrical conductors residing in the elongate member are protected against breaking.

With a microphone in the elongate member at its second end, localisation is substantially maintained when the microphone is positioned at a location within the pinna wherein the microphone receives a sound signal that allows the user to perceive the direction towards a sound source. Then, the sound signal based on which the user is capable of perceiving direction is transmitted to the ear drum of the user by the hearing aid. For example, sense of direction may be substantially maintained when the microphone is positioned at the cimba concha below the triangular fossa in the pinna.

Two microphones may be accommodated at the second end of the elongate member for provision of noise suppression and/or further directionality.

In a preferred embodiment, the housing forms an angle along its longitudinal extension facilitating accommodation of the housing in the ear canal of the user.

Preferably, the housing is flexible for variation of the angle for accommodation of the housing to different angles of different users.

Preferably, the housing is flexible for comfortable accommodation of the housing in the ear canal of the user providing a high level of comfort.

The hearing aid may further comprise a cerumen filter that is adapted to be fitted on a loudspeaker with a snap on coupling.

The housing may have a cross-section that is smaller than the cross-section of the ear canal so that occlusion substantially does not occur. When the housing is inserted into the user's ear canal, the smaller cross-section of the housing allows communication between the ear canal between the eardrum and the housing and the surroundings for prevention of occlusion.

The housing may comprise a vent. When the housing is inserted into the user's ear canal, the vent provides communication between the ear canal between the eardrum and the housing and the surroundings for prevention of occlusion. The vent may be a tube that extends through the housing providing communication between the ear canal behind the housing and the outer ear. The tube may have a substantially circular or elliptical cross-section.

The housing may be combined with a flexible earpiece part in such a way that the housing extends through a central part of the flexible earpiece part and is attached to the earpiece part. The flexible earpiece part may be of the type disclosed in EP 1 594 340.

The flexible earpiece part is adapted for positioning in the ear canal of the user and may comprise a base that is connected to the housing, the housing extending through the base, and at least one sidewall that is attached to the base and has an edge that extends substantially from the base to an opening of the earpiece part. The width of the opening fits within the ear canal of the user. The ear piece wall abuts the ear canal wall for retention of the housing in the ear canal, whereby the housing does not touch the ear canal wall for maximum comfort of the user.

The base of the earpiece part is sufficiently rigid and thick to carry and support the attached housing and earpiece part sidewall without being deformed. The sidewall is made from a thin sheet of a soft and flexible material and it functions to hold the housing in an intended position within the ear canal of the user. In this position, the base does not touch the ear canal wall. The edge allows the sidewall to adjust to the size and shape of the user's ear canal since the edge may be displaced along the surface of the ear canal when the earpiece part is being inserted against the ear canal wall. The circumferential displacement of the edge allows the sidewall to adjust to the shape and size of the user's ear canal without wrinkling and loosing contact with the ear canal so that undesirable leaks do not occur.

Preferably, the sidewall of the earpiece part has a generally conical shape. Thus, the earpiece part fits ear canals with a cross-section ranging between the smallest and largest cross sections of the conical sidewall. Thereby, the earpiece part may fit into a wide range of sizes of ear canals.

The conical shape may have a substantially elliptical cross-section. This is advantageous, as most ear canals are, more or less, oval or elliptical in shape. Thus, the earpiece part will fit well and will also be easier for the user to insert in an optimal position in the ear canal.

Furthermore, the base may comprise a vent. When the earpiece part is inserted into the user's ear canal, the vent provides communication between the ear canal behind the base of the earpiece part and the surroundings. The vent opening may be a hole in the base having a substantially circular or elliptical shape. Thereby, occlusion is prevented and the user may furthermore be able to receive sound bypassing the hearing aid processing, i.e. natural sound. The latter is often desirable e.g. in headsets, headphones, or hearing aids when the user has a limited hearing impairment, such as in the high frequency range. In this case, the user may hear low frequency sounds very well and therefore does not need the hearing aid to process these signals.

The earpiece part is preferably moulded as an integral unit. A highly suitable material is silicone.

In another embodiment, the earpiece part disclosed above is substituted by a customized part for positioning and retention of the housing in the ear canal of the user.

In a preferred embodiment of the invention, electronic feedback compensation is provided. Feedback is a well-known problem in hearing aids and several systems for suppression and cancellation of feedback exist within the art. With the development of very small digital signal processing (DSP) units, it has become possible to perform advanced algorithms for feedback suppression in a tiny hearing aid such as a hearing aid, see e.g. U.S. Pat. Nos. 5,619,580, 5,680,467 and 6,498,858.

The above mentioned prior art systems for feedback cancellation in hearing aids deal with external feedback, i.e. transmission of sound between the loudspeaker (often denoted receiver) and the microphone of the hearing aid along a path outside the hearing aid device. This problem, which is also known as acoustical feedback, occurs e.g. when a hearing aid earpiece part does not completely fit the user's ear, or in the case of an earpiece part comprising a vent. In both examples, sound may "leak" from the receiver to the microphone and thereby cause feedback.

The problem of external feedback limits the maximum gain available in a hearing aid.

Thus, the hearing aid may further comprise a feedback compensation circuit for providing a feedback compensation signal of signals picked up by the microphone by modelling an acoustical and mechanical feedback signal path of the hearing aid, subtracting means for subtracting the feedback compensation signals from the audio signal to form a compensated audio signal, which is input to the signal processor of the hearing aid.

The feedback signal path is typically an acoustic path between the microphone and the receiver, i.e. an external feedback signal propagates through air surrounding the hearing aid.

Preferably, the feedback compensation means comprises an adaptive filter, i.e. a filter that changes its impulse response in accordance with changes in the feedback path.

Both static and adaptive filters are well known to a person skilled in the art of hearing aids, and will therefore not be discussed in further detail here.

BRIEF DESCRIPTION OF THE DRAWINGS

The above and other features and advantages of the present invention will become more apparent to those of ordinary skill in the art by describing in detail exemplary embodiments thereof with reference to the attached drawings in which.

DETAILED DESCRIPTION OF PREFERRED EMBODIMENTS

Figure 1:
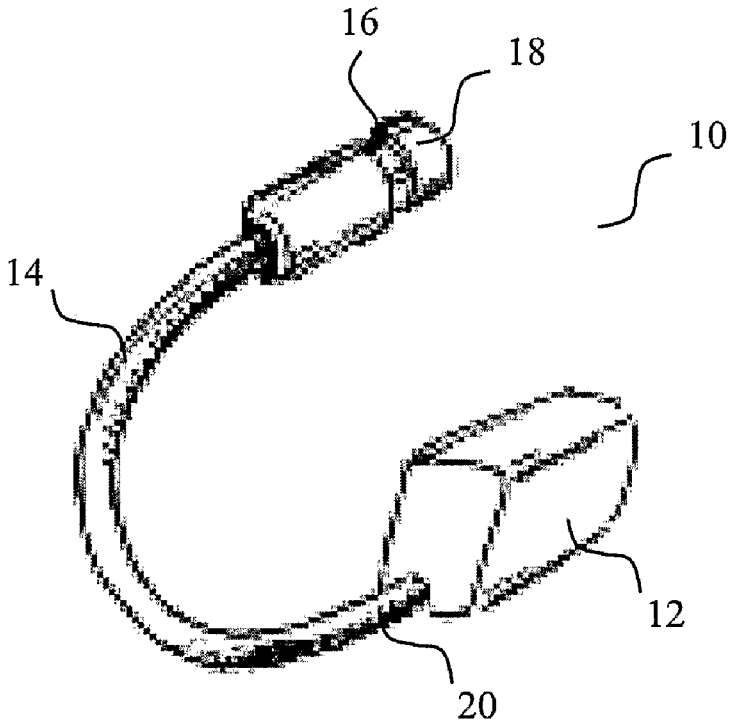
FIG. 1 is a perspective view of a first embodiment of the invention.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout except in FIG. 13 wherein reference numerals 1-16 designate electronic circuits.

Figure 2:
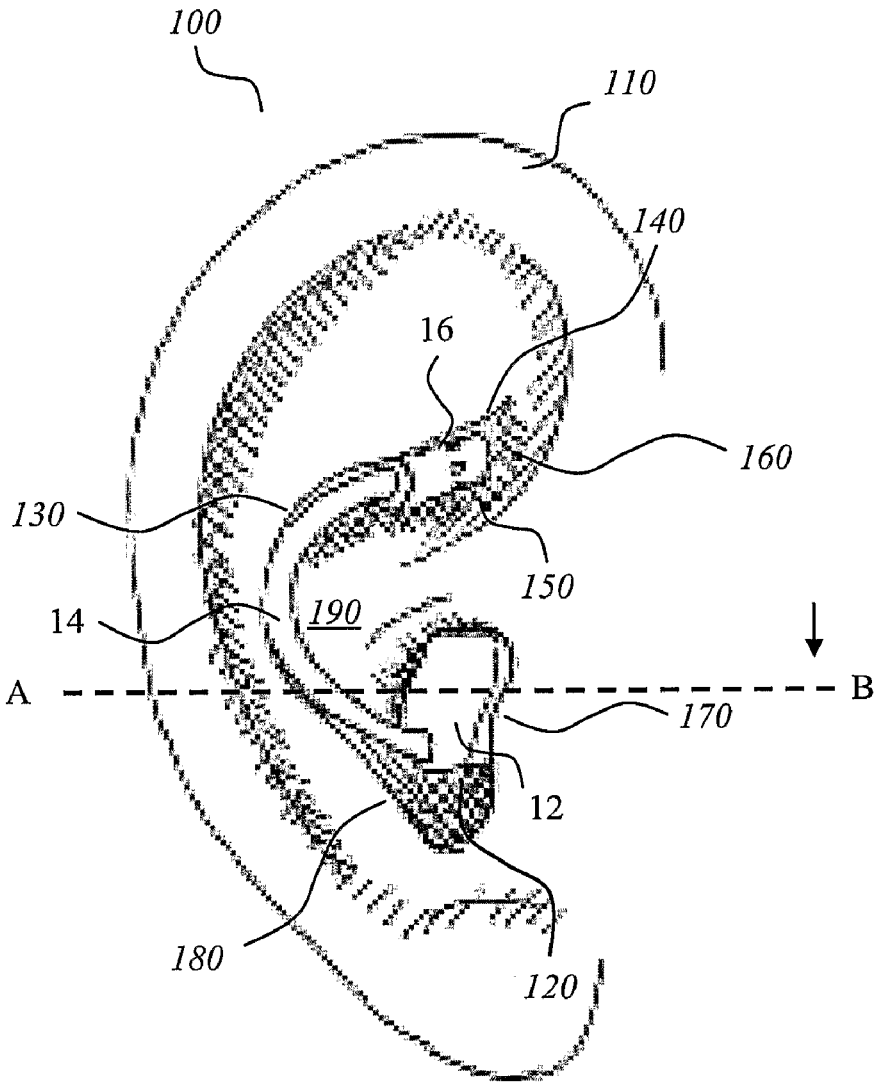
FIG. 2 shows the first embodiment positioned in the ear of a user.

FIG. 1 shows in perspective a first embodiment of a hearing aid 10 according to the present invention. FIG. 2 shows the embodiment of FIG. 1 positioned in the ear of a user. The illustrated hearing aid 10 has a housing 12 for accommodation of hearing aid components and adapted to be positioned in the ear canal 120 of a user comfortably fitting the ear canal 120 for retention of the housing 12 in the ear of the user. The housing 12 has loudspeaker (not shown) for emission of sound through an output port (not shown) towards the eardrum of the user. The housing 12 may further have a vent (not shown) for substantially eliminating the occlusion effect when the housing 12 is inserted into the ear canal 120 of the user.

The hearing aid 10 further comprises an elongate member 14 that is attached to the housing 12 and adapted for positioning within the pinna 100 during use. More specifically, the elongate member 14 is adapted to be positioned in the cimba concha 160 of the ear of the user. In the illustrated embodiment, the elongate member 14 and the housing 12 form separate units that are manufactured in separate pieces. The microphone of the hearing aid 10 is positioned at the microphone input port 16 at the second end 18 of the elongate member 14. The housing 12 accommodates the other components. Signal conductors extend within the elongate member 14 for electrical interconnection of the microphone with the other components in the housing 12.

Positioning of the microphone(s) of the hearing aid at the second end of the elongate member 14 provides an increased distance between the microphone(s) and the output port as compared to the corresponding distance in conventional ITE and CIC hearing aid devices whereby acoustic feedback is diminished.

In the illustrated embodiment, the housing 12 and elongate member 14 are manufactured as separate parts that are removably interconnected mechanically and electrically.

The illustrated housing 12 and the elongate member 14 are manufactured in a number of respective standard sizes to fit the human anatomy of the ear of most users. In this way, the manufacturing cost is lowered as compared to the manufacturing cost of customized housings.

Figure 5:
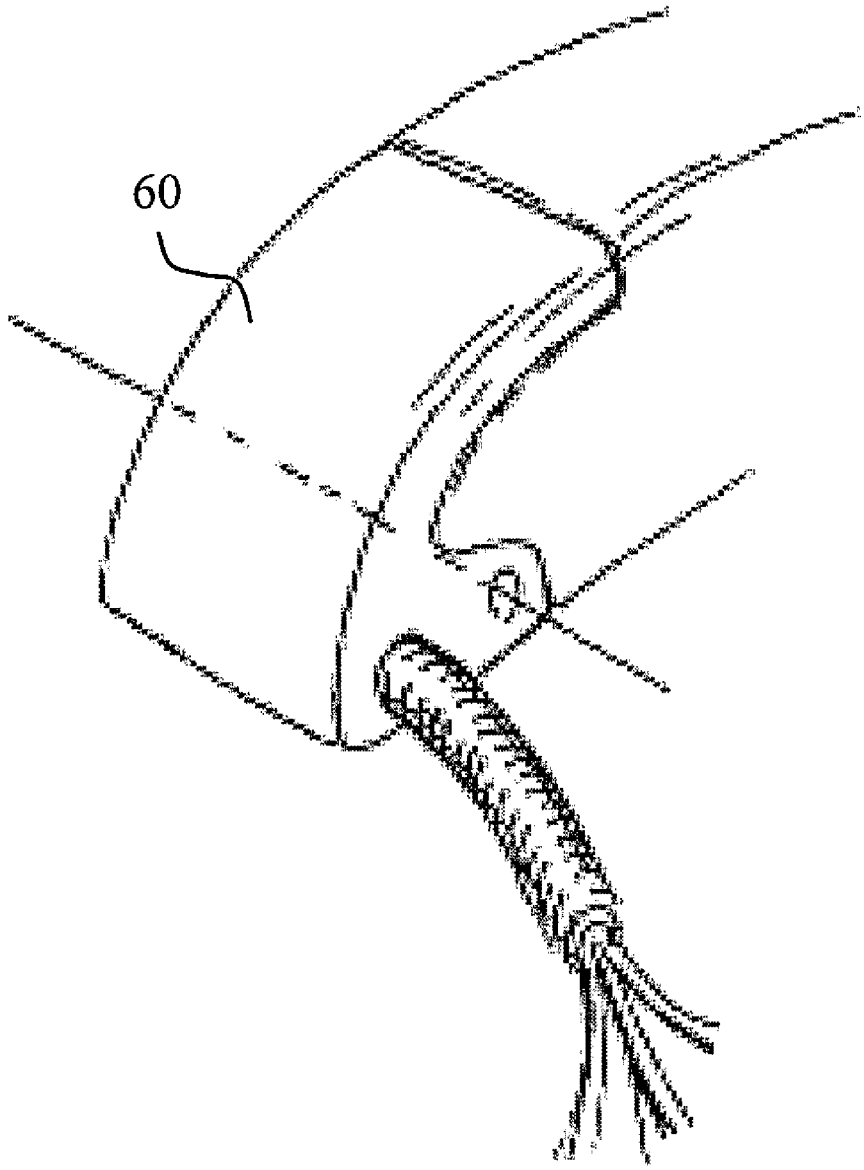
FIG. 5 shows an embodiment with a battery door.
Figure 6:
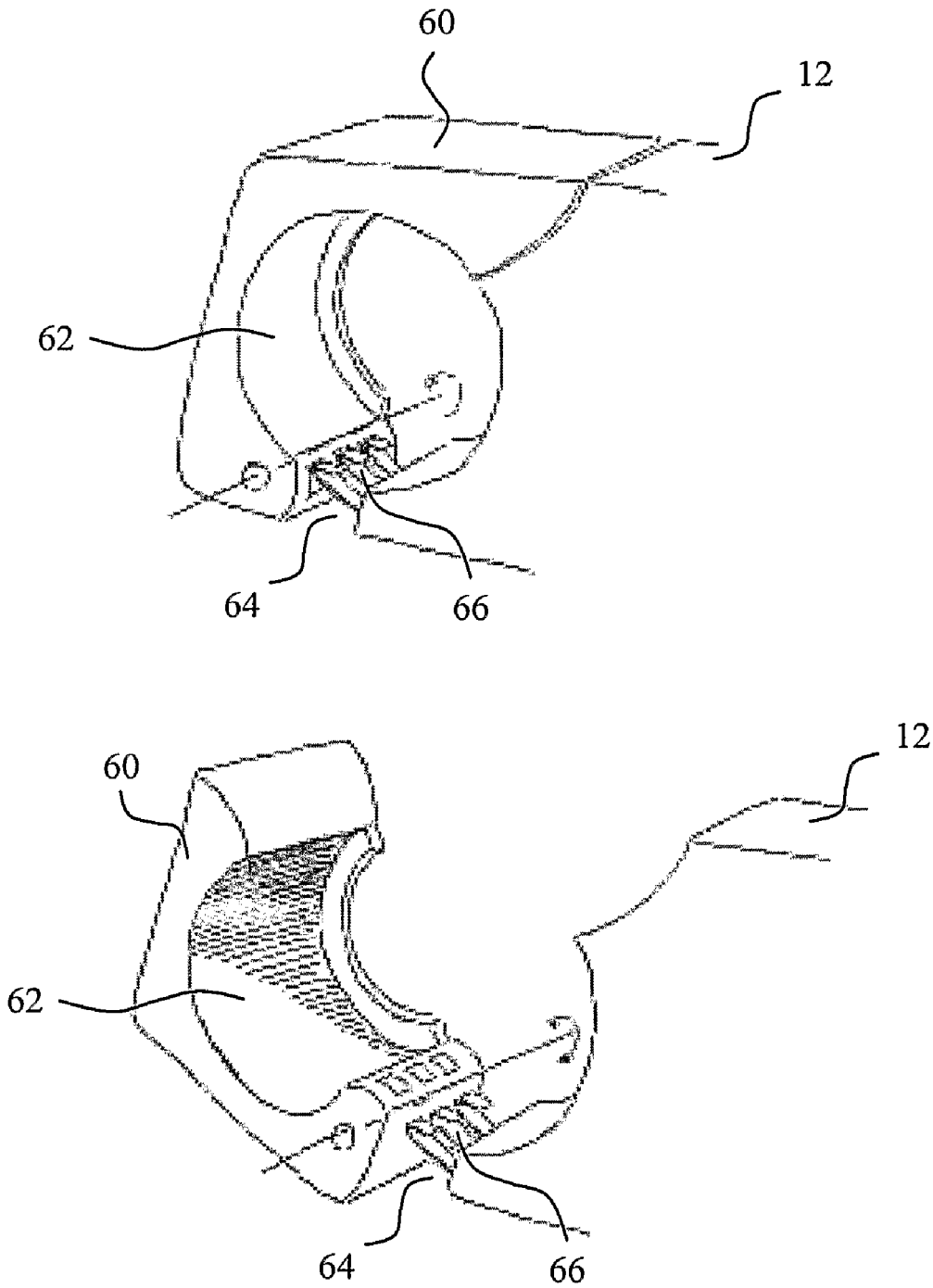
FIG. 6 shows an embodiment with a battery door and a connector.

As illustrated in more detail in FIGS. 5 and 6, the elongate member 14 is removably interconnected with the housing 12 so that a large number of different models of the hearing aid 10 may be provided by combining elongate members 14 of different standard sizes with housings 12 of different standard sizes.

The elongate member 14 is adapted to be positioned in the concha of the pinna 100 of the user and has a longitudinal shape with a first end 20 attached to the housing 12 and an opposite second end 18.

The elongate member 14 assists in retaining the housing 12 in the ear canal 120 of the user so that the housing 12 remains securely in place in the ear canal 120 without falling out of the ear. Retention is provided without causing pain to the user. Retention of the device in the proper place is important. Jaw movements during chewing for instance can exert outward forces on the housing 12 of the hearing aid. The elongate member 14 counteracts this force thereby sufficiently securing the housing 12 from outward motion.

The illustrated elongate member 14 is resilient in a direction perpendicular to its longitudinal extension thereby providing further retention capability of the housing 12 in the ear canal 120 of the user. During positioning of the housing 12 in its intended position in the ear canal 120 of the user, the transverse resilience of the elongate member 14 facilitates insertion of the housing 12 into the ear canal 120 of the user.

The elongate member 14 is adapted to abut the antihelix 130 and extend to the inferior crus 150 of the antihelix so that the second end 18 is positioned at the cimba concha 160 of the ear below the triangular fossa when the hearing aid 10 is positioned in the ear of the user.

The elongate member 14 has a larger cross-section at the second end 18 accommodating the microphone than a remaining part of the elongate member 14 extending therefrom and towards the first end 20.

The elongate member 14 may accommodate further electrical hearing aid components.

The illustrated elongate member 14 is substantially rigid in the direction of its longitudinal extension so that electrical conductors residing in the elongate member 14 are protected against breaking.

With a microphone in the elongate member 14 at its second end 18 that is positioned at the cimba concha 160 of the ear below the triangular fossa, localisation is substantially maintained since the microphone is positioned at a location within the pinna 100 wherein the received sound signal enables the user to perceive direction towards a sound source from the signal transmitted to the ear drum of the user by the hearing aid 10.

Two microphones may be accommodated at the second end 18 of the elongate member 14 for provision of noise suppression and/or further directionality.

Figure 3:
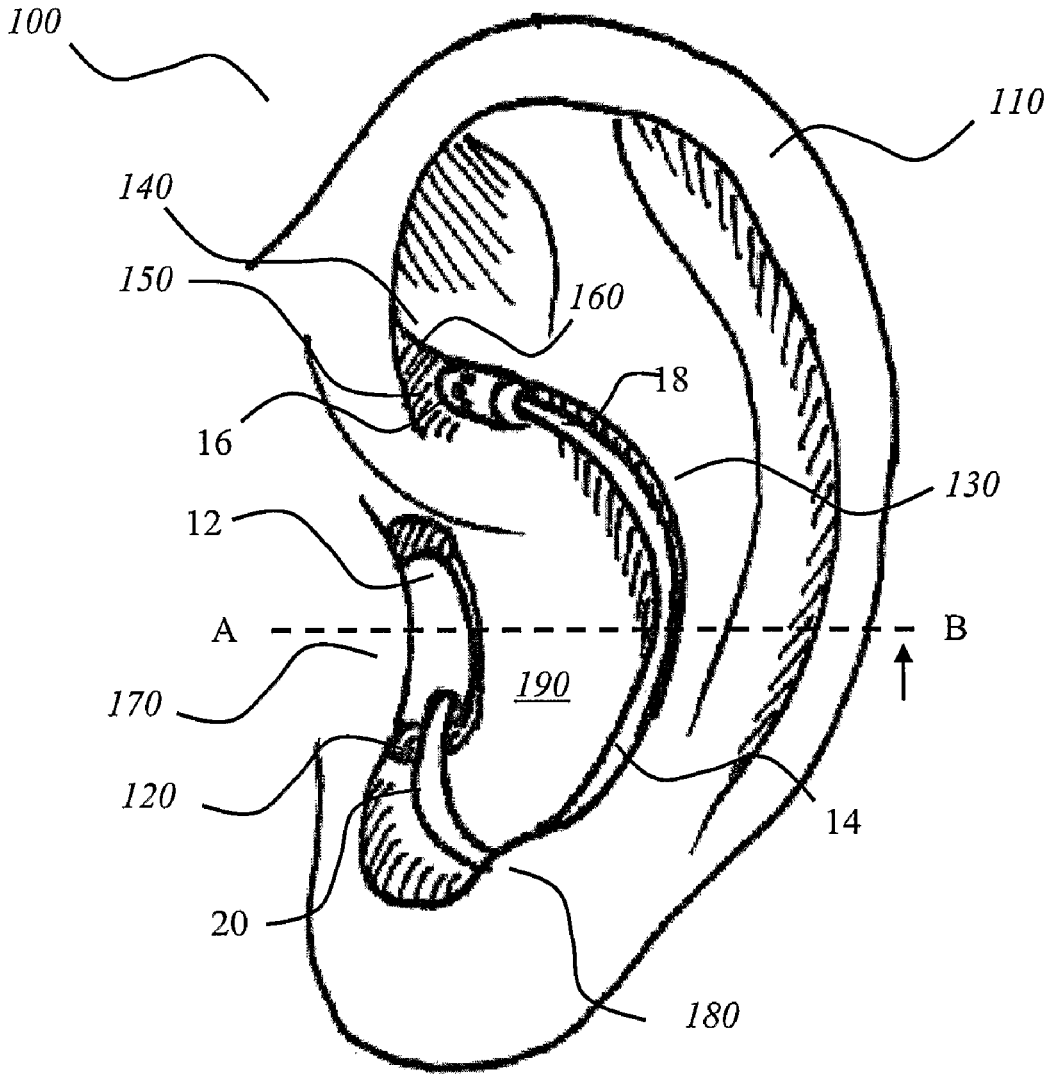
FIG. 3 shows a second embodiment positioned in an ear of a user.
Figure 7:
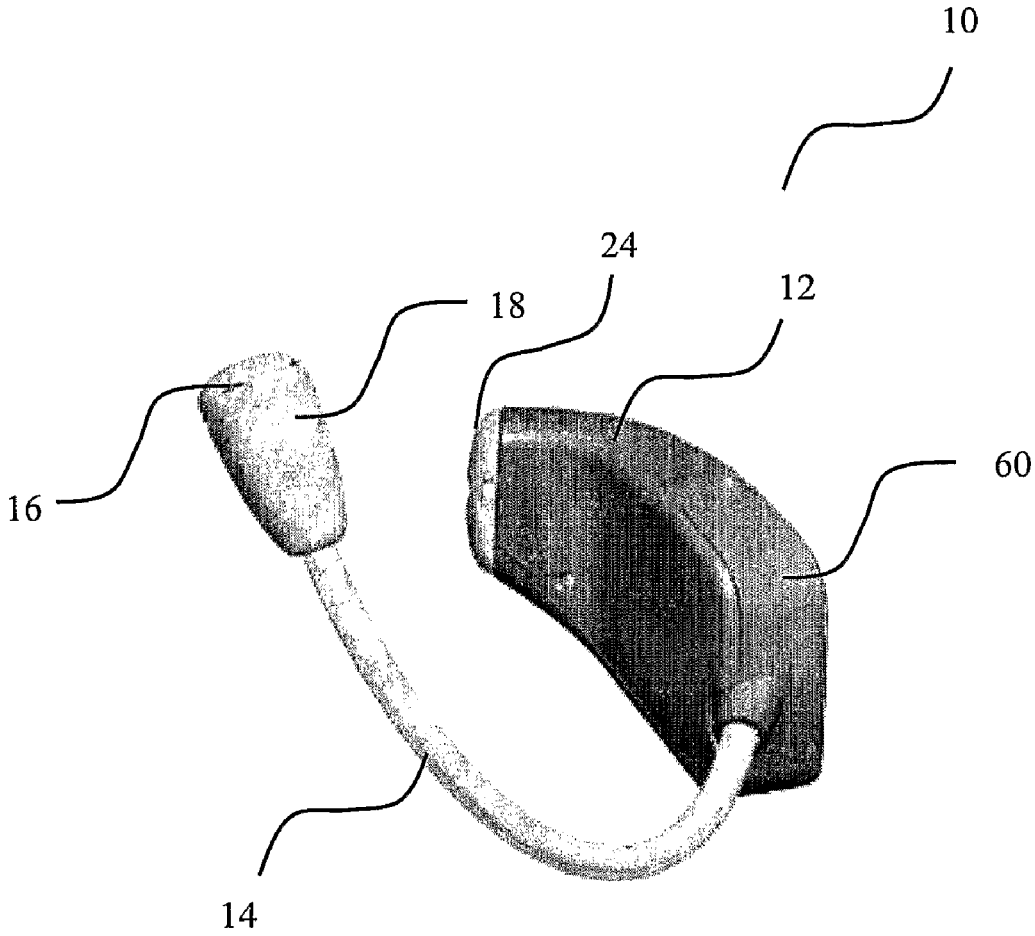
FIG. 7 shows in perspective an embodiment of a hearing aid according to the present invention.

FIG. 3 shows another embodiment of a hearing aid according to the present invention also shown in FIG. 7 positioned in an ear of a user. The illustrated hearing aid may have all of the features of the hearing aid shown in FIGS. 1 and 2.

In addition to the features of the elongate member 14 shown in FIGS. 1 and 2, the elongate member shown in FIGS. 3 and 7 is further adapted to abut part of the concha at the antitragus 180 when the housing 12 has been inserted in the ear canal 120 thereby applying a force to the housing towards the ear canal retaining the housing in a position in which the housing is pressed against an anatomical feature within the ear canal.

Figure 4:
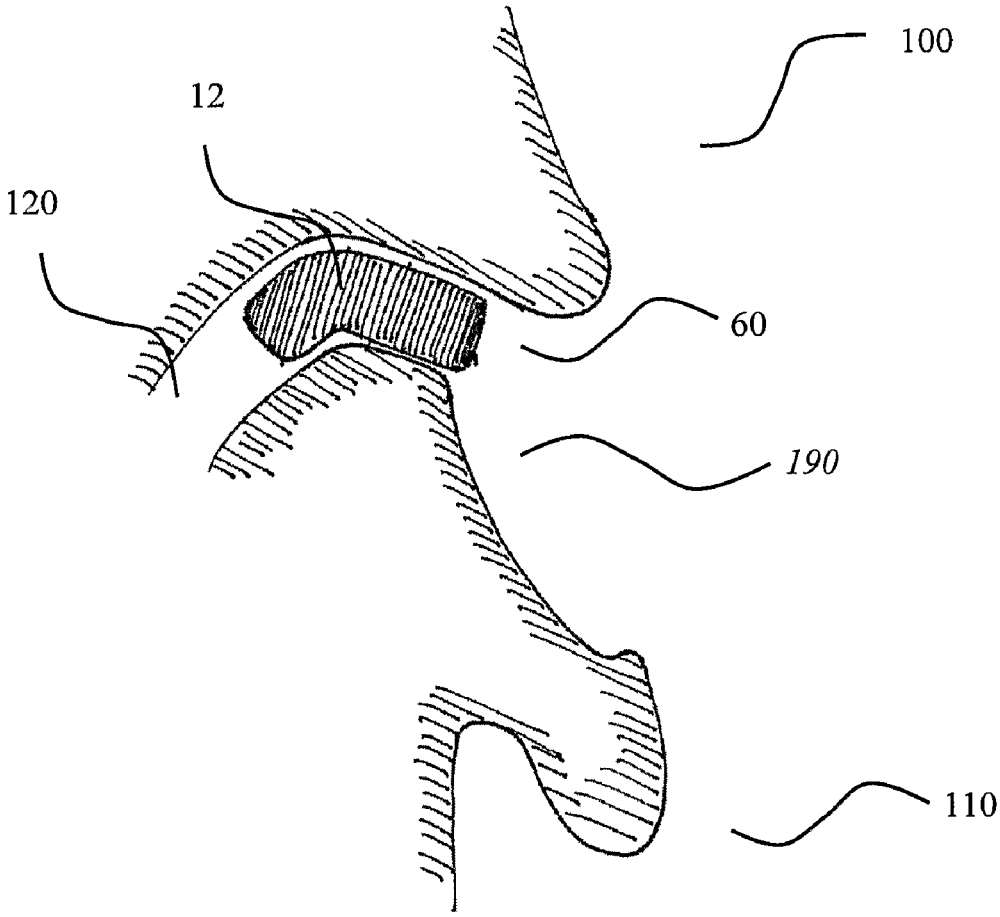
FIG. 4 illustrates the position of the hearing aid housing in the ear canal during use.

FIG. 4 shows the positioning of a the hearing aid housing in the ear canal 120 of a user. The cross-section of FIG. 4 is taken along line AB in FIG. 2 or 3. The viewing direction is indicated by the arrow. The housing 12 forms an angle along its longitudinal extension facilitating accommodation of the housing in the ear canal 120 of the user.

Preferably, the housing is flexible for variation of the angle for accommodation of the housing to different angles of different users. Preferably, the housing is flexible for comfortable accommodation of the housing in the ear canal of the user providing a high level of comfort.

The illustrated housing 12 has a cross-section that is smaller than the cross-section of the ear canal 120 so that occlusion substantially does not occur. When the housing 12 is inserted into the user's ear canal 120, the smaller cross-section of the housing allows communication between the ear canal between the eardrum and the housing and the surroundings for prevention of occlusion. The illustrated hearing aid housing 12 is positioned completely in the ear canal of the user like a conventional CIC hearing aid. When the hearing aid housing is properly inserted into the ear canal of the user, the outward pointing end of the hearing aid housing with the battery door 60 is aligned with, or approximately aligned with, the cavum conchae 190, i.e. the battery door 60 coincides with, or approximately coincides with, the delimitation between the cavum conchae and the ear canal.

FIGS. 5 and 6 illustrate an embodiment of a battery door 60 of the housing 12 in more detail. The battery door 60 is provided at the proximate end of the housing 12 facing out of the ear canal when the hearing aid 10 is positioned in the ear. The battery door 60 has a compartment 62 accommodating the battery (not shown). The battery compartment 62 swings out of the housing 12 when the battery door 60 is opened whereby the battery may be exchanged with a new battery. The elongate member 14 is attached to the battery door 60 and the battery door 60 is removably attached to the housing 12 with a connector 64 comprising resilient electrical contact members 66 for electrical interconnection of signal conductors in the elongate member 14 with electrical components in the housing 12.

FIG. 7 shows in perspective an embodiment of a hearing aid 10 according to the present invention. As already mentioned with reference to FIG. 3, the features of the hearing aid illustrated in FIG. 7 may have all of the features of the hearing aid shown in FIGS. 1 and 2. The embodiment of FIGS. 3 and 7 comprises a cerumen filter 24 that is fitted on the part of the housing 12, which part accommodates the loudspeaker. The cerumen filter 24 is coupled to the housing 12 by means of a snap fit coupling.

Figure 8:
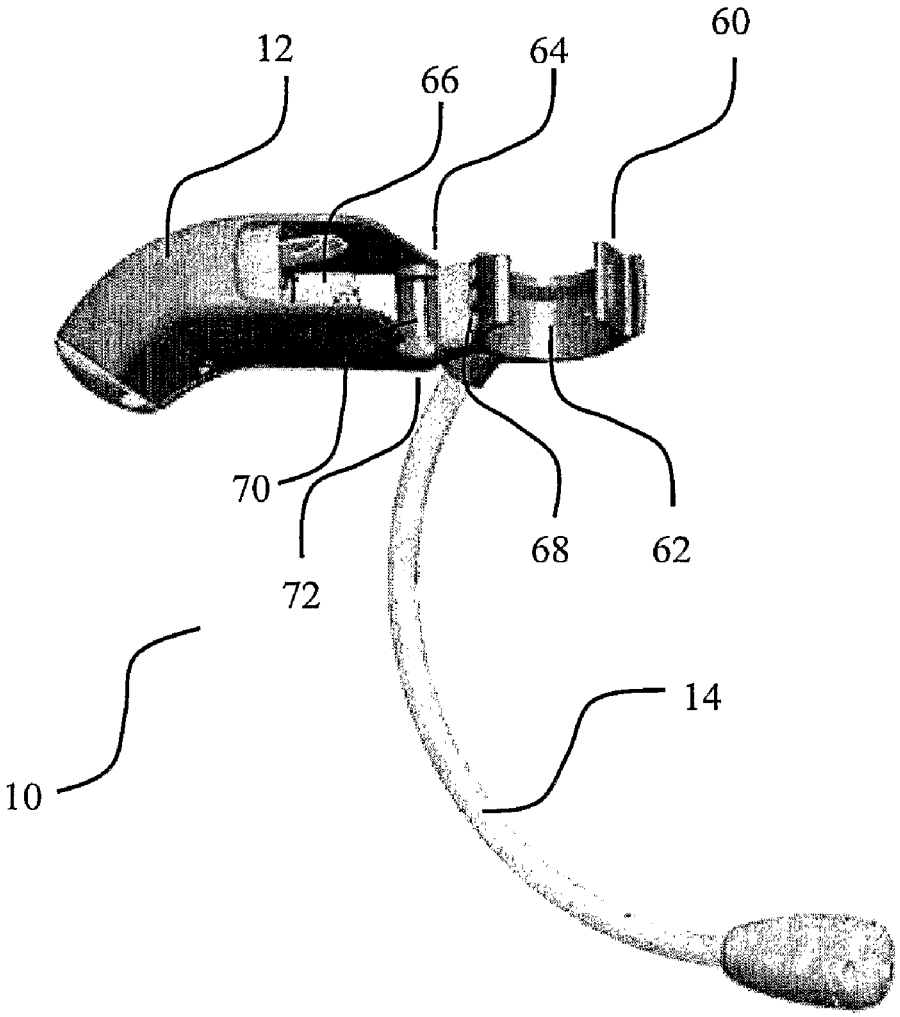
FIG. 8 shows from above the embodiment of FIG. 7 with an open battery door.

FIG. 8 shows from above the embodiment of FIG. 7 with an open battery door 60. The battery door 60 is provided at the proximate end of the housing 12 pointing out of the ear canal when the hearing aid 10 is positioned in the ear. The battery door 60 has a compartment 62 accommodating the hearing aid battery (not shown). The user may open or close the battery door 60 by rotating the battery door around an axis of rotation provided by a hinge connection 72. The battery compartment 62 swings out of the housing 12 when the battery door 60 is opened whereby the battery may be exchanged with a new battery.

The elongate member 14 is attached to the battery door 60 and the battery door 60 is removably attached to the housing 12 with a connector 64 including the hinge connection 72. In the illustrated embodiment, the hinge connection 72 has a shaft 74, and the battery door 60 has a flexible recess 76 so that a person may attach the battery door 60 to the hearing aid housing 12 by pressing the recess 76 around the shaft 74 whereby the recess 76 expands slightly to accommodate the shaft 74 and snaps back for retention of the shaft within the recess. Likewise, the user may remove the battery door 60 from the hearing aid housing 12 by pulling the battery door 60 away from the hearing aid housing 12 whereby the recess expands to release the shaft and snaps back into its original relaxed shape upon release of the shaft 74. The illustrated snap fit coupling for interconnection of the battery door 60 with the hearing aid housing 12 is designed so that the force required to separate the battery door 60 from the hearing aid housing 12 is larger than the force required to pull the hearing aid housing 12 out of the ear canal of the user by pulling the elongate member 14.

The illustrated hearing aid housing connector 64 further comprises resilient electrical contact members 66 for electrical interconnection of signal conductors in the elongate member 14 with electrical components in the housing 12.

Figure 9:
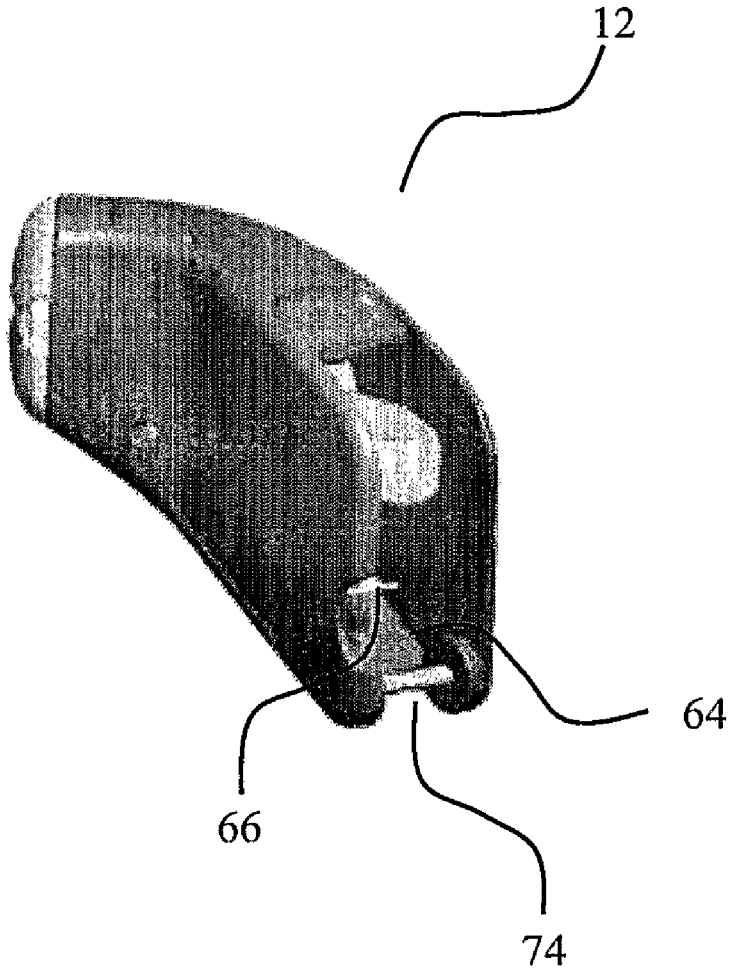
FIG. 9 shows the hearing aid housing of the embodiment of FIGS. 7 and 8.
Figure 10:
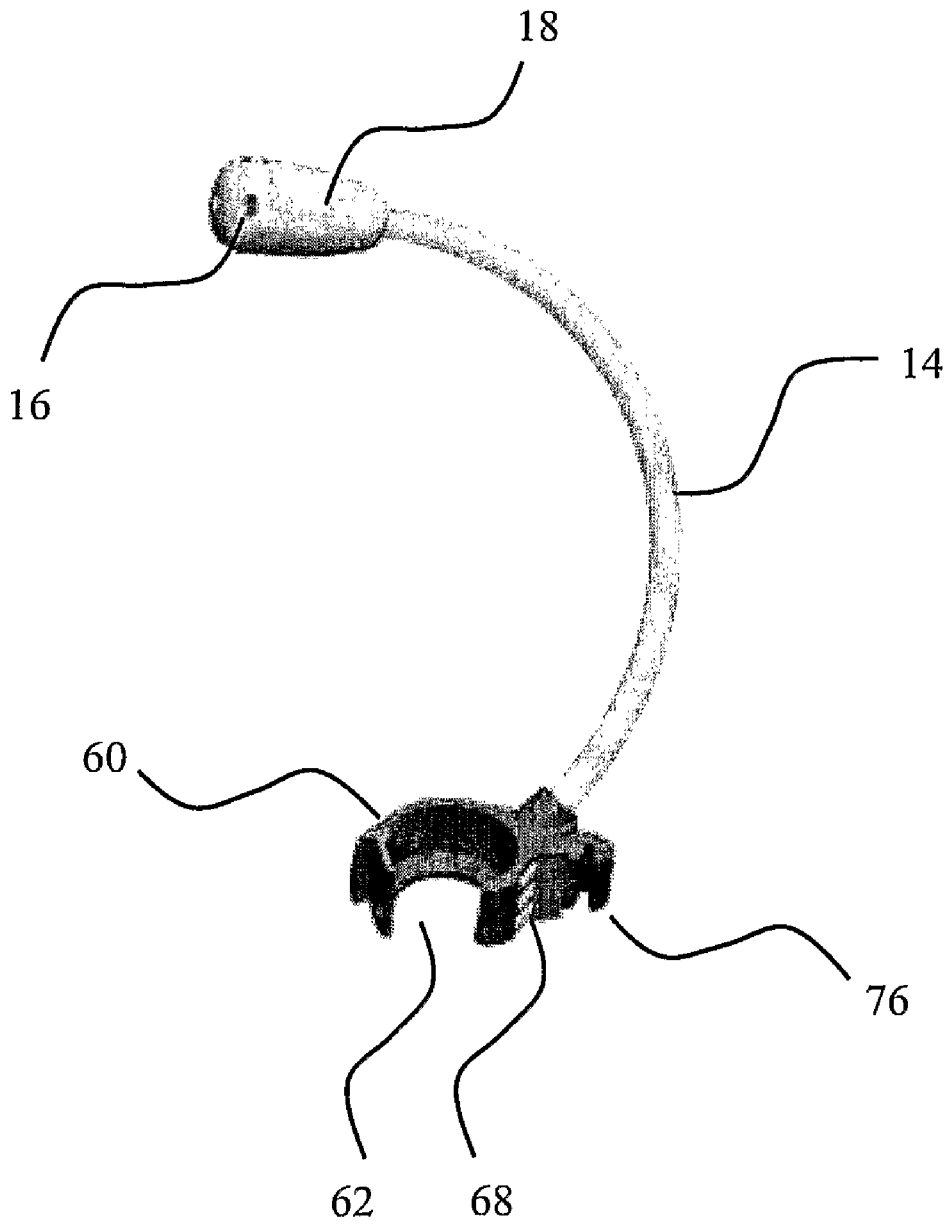
FIG. 10 shows the elongate member connected to a battery door of the embodiment of FIGS. 7 and 8.

FIG. 9 shows the hearing aid housing 12 with the battery door 60 removed, and FIG. 10 shows the removed battery door 60 with the elongate member 14.

It is an important advantage of the illustrated embodiment that electrical contact members 68 of the interconnected battery door 60 and elongate member 14 mating the contact members 66 of the hearing aid housing connector 64 connect slidably with respective electrical contact members 66 of the housing 12 when the battery compartment 62 is closed by rotation. The sliding connection provides a cleaning action thereby cleaning the contact surfaces maintaining a low contact resistance across the electrical interconnection of the hearing aid components, e.g. by mechanical removal of oxide film formed on the contact surfaces, or mechanical removal of other undesired deposits on the contact surfaces.

In another embodiment of the present invention, the elongate member 14 is removably connected directly with the hearing aid housing 12. In this embodiment (not shown), the elongate member 14 has an electrical connector at its second end mating a corresponding hearing aid housing connector. The elongate member 14 with the connector is inserted through a hole provided in the hearing aid housing. The battery door 60 may be provided with a suitable mechanical member that assists in attaching the elongate member 14 to the hearing aid housing 12 by abutment with the elongate member 14 when the battery door 60 is closed. The battery door may include locking means preventing the battery door from being inadvertently opened e.g. due to forces applied to the elongate member 14.

Figure 11:
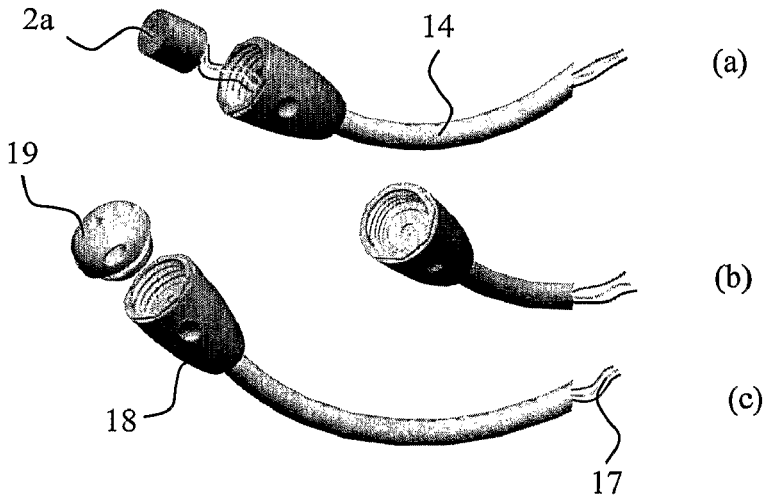
FIG. 11 illustrates positioning of a microphone at the second end of an elongate member.

FIGS. 11 (*a*)-(*c*) illustrate positioning of a microphone 2*a* at the second end 18 of an elongate member 14 in accordance with an embodiment of the invention. As shown in FIG. 11 (*a*), the microphone 2*a* and its signal conductors 17 are inserted into the elongate member 14 through an open second end 18 of the elongate member 18, and the microphone 2*a* is pushed into its desired position shown in FIG. 11 (*b*). The signal conductors 17 with the signal line of the microphone 2*a* extend inside the elongate member 14. Finally, a threaded cap 19 with the cerumen filter closes the opening of the elongate member 14 as illustrated in FIG. 11 (*c*).

Figure 12:
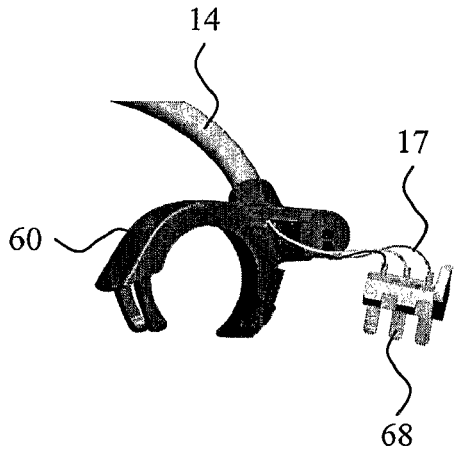
FIG. 12 shows a detail of an interconnection between an elongate member and a battery door.

FIG. 12 illustrates the interconnection of the signal conductors 17 with the contact members 68 in accordance with an embodiment of the invention. In the illustrated embodiment, the contact members 68 are provided on a slide member that may slide into a mating compartment in the battery door for positioning of the contact members 68 as for example illustrated in FIG. 10. Upon insertion of the microphone 2*a* and the signal conductors 17 into the elongate member 14, the exposed ends of the signal conductors 17 or soldered onto the contact members 68 provided on the slide member. Subsequently, the slide member is inserted into the battery door 60 and possibly glued to the battery door.

Figure 13:
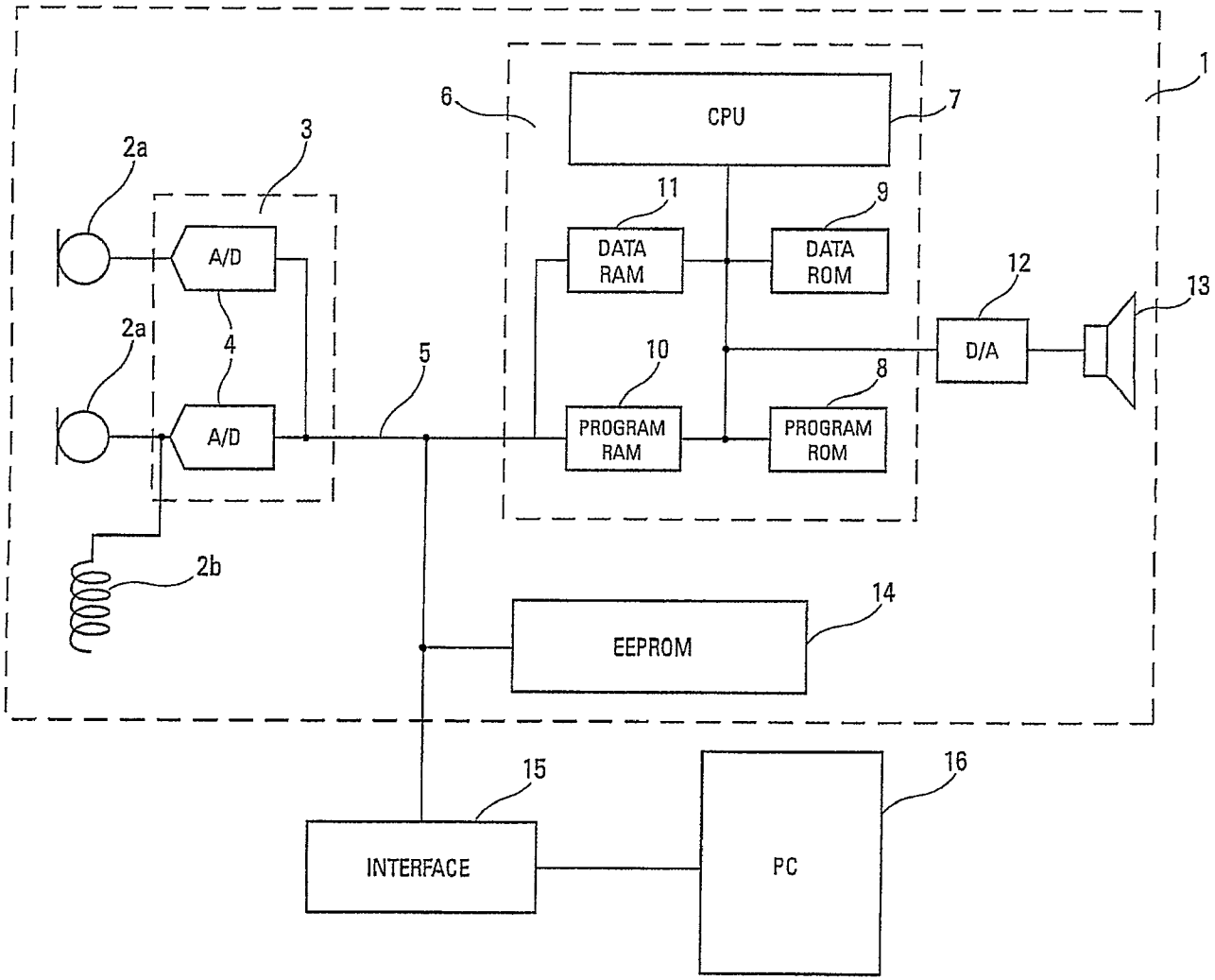
FIG. 13 shows a simplified block diagram of a digital hearing aid enclosed in a housing according to the present invention.

FIG. 13 shows a simplified block diagram of a digital hearing aid according to the present invention. The hearing aid 1 comprises one or more sound receivers 2, e.g. two microphones 2*a* and a telecoil 2*b*. The analogue signals for the microphones are coupled to an analogue-digital converter circuit 3, which contains an analogue-digital converter 4 for each of the microphones.

The digital signal outputs from the analogue-digital converters 4 are coupled to a common data line 5, which leads the signals to a digital signal processor (DSP) 6. The DSP is programmed to perform the necessary signal processing operations of digital signals to compensate hearing loss in accordance with the needs of the user. The DSP is further programmed for automatic adjustment of signal processing parameters in accordance with the present invention.

The output signal is then fed to a digital-analogue converter 12, from which analogue output signals are fed to a sound transducer 13, such as a miniature loudspeaker.

In addition, externally in relation to the DSP 6, the hearing aid contains a storage unit 14, which in the example shown is an EEPROM (electronically erasable programmable read-only memory). This external memory 14, which is connected to a common serial data bus 5, can be provided via an interface 15 with programmes, data, parameters etc. entered from a PC 16, for example, when a new hearing aid is allotted to a specific user, where the hearing aid is adjusted for precisely this user, or when a user has his hearing aid updated and/or re-adjusted to the user's actual hearing loss, e.g. by an audiologist.

The DSP 6 contains a central processor (CPU) 7 and a number of internal storage units 8-11, these storage units containing data and programmes, which are presently being executed in the DSP circuit 6. The DSP 6 contains a programme-ROM (read-only memory) 8, a data-ROM 9, a programme-RAM (random access memory) 10 and a data-RAM 11. The two first-mentioned contain programmes and data which constitute permanent elements in the circuit, while the two last-mentioned contain programmes and data which can be changed or overwritten.

Typically, the external EEPROM 14 is considerably larger, e.g. 4-8 times larger, than the internal RAM, which means that certain data and programmes can be stored in the EEPROM so that they can be read into the internal RAMs for execution as required. Later, these special data and programmes may be overwritten by the normal operational data and working programmes. The external EEPROM can thus contain a series of programmes, which are used only in special cases, such as e.g. start-up programmes.

Figure 14:
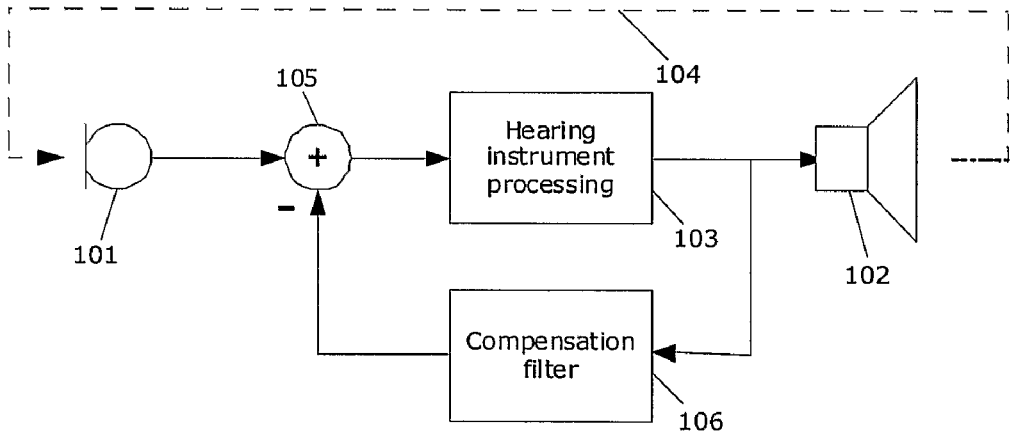
FIG. 14 shows a block-diagram of a hearing aid with one feedback compensation filter.

A block-diagram of an embodiment of a hearing aid with a feedback compensation filter 106 is shown in FIG. 14. The hearing aid comprises a microphone 101 for receiving incoming sound and converting it into an audio signal. A receiver 102 converts output from the hearing aid processor 103 into output sound, which in, e.g., a hearing aid is supposed to be modified to compensate for a users hearing impairment. Thus, the hearing aid processor 103 comprises elements such as amplifiers, compressors and noise reduction systems etc.

A feedback path 104 is shown as a dashed line between the receiver 102 and the microphone 101. Due to the feedback path, the microphone 101 may pick up sound from the receiver 102 which may lead to well known feedback problems, such as whistling.

The (frequency dependent) gain response (or transfer function) H(ω) of the hearing aid (without feedback compensation) is given by:

$$H(\omega) = \frac{A(\omega)}{1 - F(\omega)A(\omega)} \tag{1}$$

where ω represents (angular) frequency, F(ω) is the gain function of the feedback path 104 and A(ω) is the gain function provided by the hearing aid processor 103. The feedback compensation filter 106 is adapted to feed a compensation signal to the subtraction unit 105, whereby the compensation signal is subtracted from the audio signal provided by the microphone 101 prior to processing in the hearing aid processor 103. The transfer function now becomes:

$$H(\omega) = \frac{A(\omega)}{1 - (F(\omega) - F'(\omega))A(\omega)} \tag{2}$$

where F'(ω) is the gain function of the compensation filter 106. Thus, F'(ω) estimates the true gain function F(ω) of the feedback path, the closer H(ω) will be to the desired gain function A(ω).

As previously explained, the feedback path 104 is usually a combination of internal and external feedback paths and acoustical and mechanical feedback paths.

Figure 15:
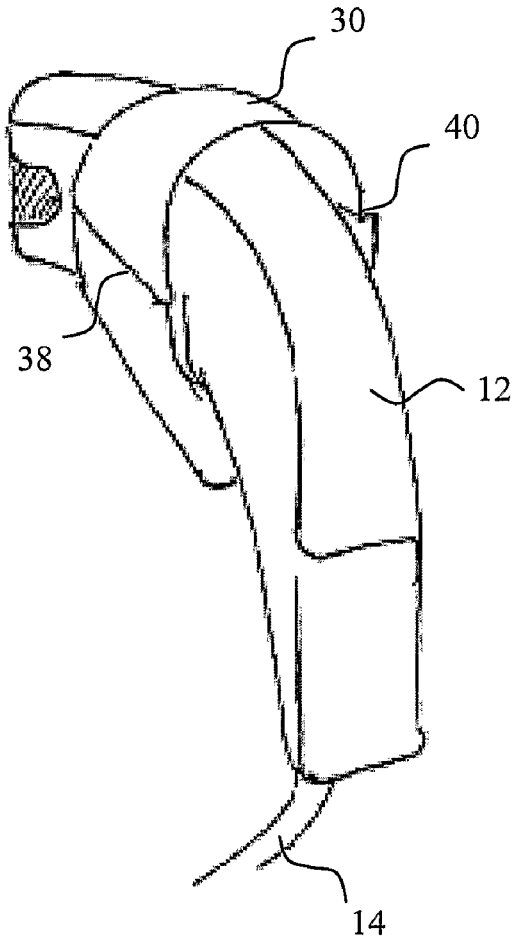
FIG. 15 shows a hearing aid housing with an earpiece part.
Figure 16:
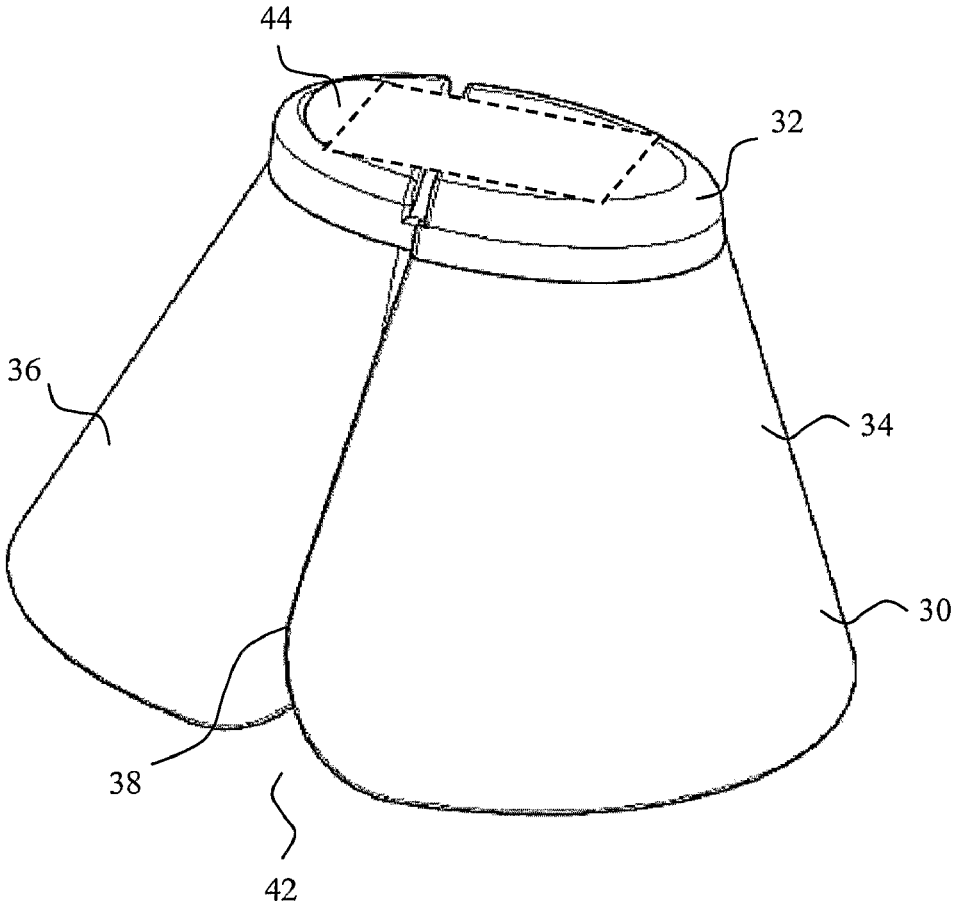
FIG. 16 shows the earpiece part of the embodiment of FIG. 15 in more detail.

FIG. 15 illustrates an embodiment wherein the housing 12 is attached to a flexible earpiece part 30. The housing 12 extends through a central part of the flexible earpiece part 30 and is attached to the earpiece part 30. The flexible earpiece part 30 is adapted for positioning in the ear canal of the user and comprises a base 32 that is connected to the housing 12. As illustrated in more detail in FIG. 16, the flexible earpiece part has two sidewalls 34, 36 that are attached to the base 32. Each of the sidewalls 34, 36 has a respective edge 38, 40 that extends substantially from adjacent parts of the base 32 to an opening 42 of the earpiece part 30. The width of the opening 42 fits within the ear canal of the user. The ear piece walls 34, 36 abut the ear canal wall for retention of the housing 12 in the ear canal 120 so that the housing 12 does not touch the ear canal wall for maximum comfort of the user.

The base 32 of the earpiece part is sufficiently rigid and thick to carry and support the attached housing 12 and earpiece part sidewalls 34, 36 without being deformed. The sidewalls 34, 36 are made from a thin sheet of a soft and flexible material and they hold the housing 12 in an intended position within the ear canal 120 of the user. In this position, the base 32 does not touch the ear canal wall. The edges 38, 40 allow the sidewalls 34, 36 to adjust to the size and shape of the user's ear canal 120 since the edges 38, 40 may be displaced along the surface of the ear canal 120 when the earpiece part is being inserted and pressure thereby is applied to the sidewalls 34, 36 by the ear canal wall. The circumferential displacement of the edges 38, 40 allows the sidewall to adjust to the shape and size of the user's ear canal 120 without wrinkling and loosing contact with the ear canal 120 so that undesirable leaks do not occur.

The sidewalls 34, 36 are mutually overlapping so that the edge of one sidewall is covered by the other sidewall whereby only one of the edges 38, 40 is in direct contact with the skin of the ear canal 120 when the earpiece part is in use. This reduces the risk of undesired openings or leaks in the earpiece part along the edges 38, 40 of the sidewalls 34, 36.

The sidewalls 34, 36 of the earpiece part 30 impart a generally conical shape to the earpiece part 30. Thus, the earpiece part fits ear canals with cross-sections ranging between the smallest and largest cross sections of the conical sidewalls 34, 36.

As illustrated, the conical shape has a substantially elliptical cross-section. This is advantageous since an ear canal typically has a substantially oval or elliptical shape.

One of the sidewalls is thickest along the edge of the first sidewall, while the other sidewall is thinnest along the edge of the second sidewall. Thus, the first sidewall will be more rigid along its edge while the second sidewall will be softer or more flexible along the edge. If the edge of the second sidewall is positioned between the ear canal and the first sidewall, then the rigidness of the first sidewall will provide an outward pressure on the second sidewall in the direction of the ear canal surface. The flexibility of the second sidewall therefore assures close contact between itself and both of the first sidewall and the surface of the ear canal. Thereby, undesired leaks are prevented along the edges of the sidewalls as well as a close and tight fit in the ear canal.

The thinnest parts of the sidewalls are preferably about half the thickness of the thickest parts. The thinnest part may have a thickness in the range of 0.05 mm to 0.5 mm, such as in the range of 0.1 mm to 0.45 mm, such as in the range of 0.15 mm to 0.4 mm, such as in the range of 0.2 mm to 0.35 mm, such as in the range of 0.25 mm to 0.3 mm. Accordingly, the thickest part may have a thickness in the range of 0.1 mm to 1.0 mm, such as in the range of 0.2 mm to 0.9 mm, such as in the range of 0.3 mm to 0.8 mm, such as in the range of 0.4 mm to 0.7 mm, such as in the range of 0.5 mm to 0.6 mm.

Furthermore, the base may comprise a vent 44. When the earpiece part is inserted into the user's ear canal, the vent 44 provides communication between the ear canal behind the base 32 of the earpiece part 30 and the surroundings. The vent opening may be a hole in the base having a substantially circular or elliptical shape. Thereby, occlusion is prevented.

The earpiece part 30 is moulded. A highly suitable material is silicone.

Figure 17:
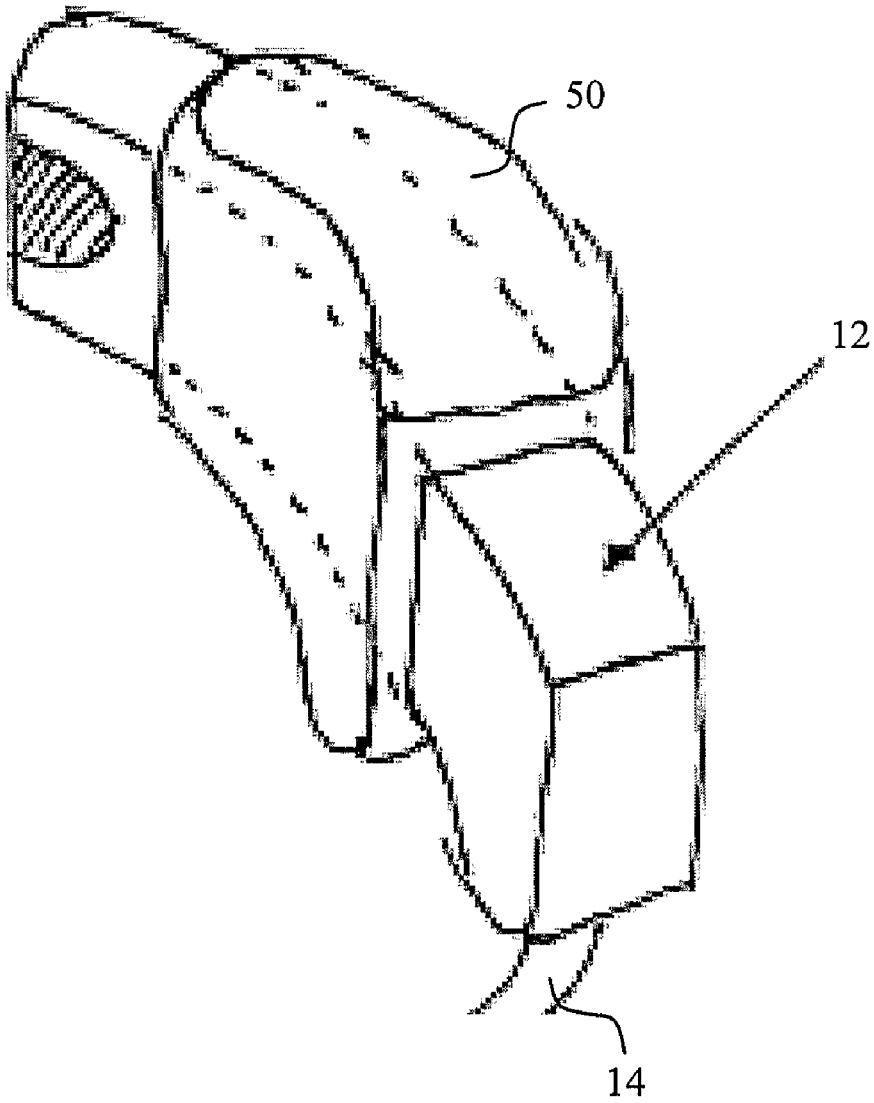
FIG. 17 shows a hearing aid housing with a customized part.

FIG. 17 shows an embodiment of the invention wherein the housing 12 has a customized part 50 for positioning and retention of the housing 12 in the ear canal of the user.

The invention claimed is:

1. An elongate member comprising an elongate body and a securing mechanism configured for removably coupling the elongate body with a hearing aid having a housing that is configured for positioning in an ear canal of a user and that accommodates a signal processor for processing an audio signal into a processed audio signal compensating a hearing loss, the hearing aid further having a receiver that is connected to an output of the signal processor for providing a sound signal based on the processed audio signal, wherein the securing mechanism is a part of a battery door having at least a portion configured for removable attachment to the housing of the hearing aid.

2. The elongate member according to claim 1, wherein the securing mechanism comprises a connector that is configured for removable attachment to the hearing aid.

3. The elongate member according to claim 2, wherein the connector comprises a snap fit coupling.

4. The elongate member according to claim 1, further comprising a microphone coupled to the elongate body.

5. The elongate member according to claim 4, wherein the elongate body has a first end and a second end, the microphone is located at the second end, and the securing mechanism is located closer to the first end than the second end.

6. the hearing aid according to claim 5, wherein the securing mechanism is configured to removably couple to an end of the housing facing away from the ear canal when the housing is placed in the ear canal.

7. The elongate member according to claim 4, further having a signal line located in the elongate body.

8. The elongate member according to claim 1, wherein the elongate body has a standard size.

9. The elongate member according to claim 1, wherein the elongate body is configured for positioning in a pinna and outside the ear canal of the user for retention of the housing in the ear canal during use.

10. The elongate member according to claim 1, wherein the elongate body is configured to abut an antihelix and extends at least to an inferior crus of an antihelix during use.

11. The elongate member according to claim 1, wherein the elongate body has a first end and a second end, the second end being a free end, wherein the elongate body is configured so that the second end is positioned below a triangular fossa of the user during use.

12. The elongate member according to claim 1, wherein the elongate body is configured to abut part of a concha at an antitragus when the housing has been inserted in the ear canal thereby applying a force to the housing towards the ear canal retaining the housing in a position in which the housing is pressed against an anatomical feature within the ear canal.

13. The elongate member according to claim 1, wherein the elongate body is flexible and preformed.

14. The elongate member according to claim 1, wherein the elongate body is substantially rigid in its longitudinal direction.

15. The elongate member according to claim 1, further comprising a microphone accommodated in the elongate body, wherein a part of the elongate body accommodating the microphone has a larger cross-section than a remaining part of the elongate body.

16. The elongate member according to claim 1, comprising two microphones.

17. A hearing aid comprising:

a housing that is configured for positioning in an ear canal of a user and that accommodates a signal processor for processing an audio signal into a processed audio signal compensating a hearing loss;

a receiver connected to an output of the signal processor for providing a sound signal based on the processed audio signal; and an elongate member configured for removably coupling to the housing, wherein the elongate member comprises a battery door having at least a portion configured for removable attachment to the housing.

18. The hearing aid according to claim 17, the housing leaving a passageway between a part of an ear canal wall and a part of the housing so that sound waves may escape from behind the housing through the passageway to surroundings of the user when the housing is positioned in the ear canal of the user.

19. The hearing aid according to claim 17, wherein the housing is configured to be positioned completely in the ear canal of the user.

20. The hearing aid according to claim 17, wherein the housing has a standard size.

21. The hearing aid according to claim 17, wherein the housing forms an angle along its longitudinal extension for facilitating accommodation of the housing in the ear canal of the user.

22. The hearing aid according to claim 21, wherein the angle is variable.

23. The hearing aid according to claim 17, further comprising a loudspeaker, and a cerumen filter that is configured to be fitted on the loudspeaker with a snap on coupling.

24. The hearing aid according to claim 17, further comprising an electronic feedback suppression mechanism located in the housing.

25. The hearing aid according to claim 17, wherein the housing further comprises a flexible earpiece part for positioning and retention of the housing in the ear canal of the user.

26. The hearing aid according to claim 17, wherein the housing further comprises a customized part for positioning and retention of the housing in the ear canal of the user.

27. The hearing aid according to claim 17, wherein the elongate member has a first end, and a second end that is a free end.

28. The hearing aid according to claim 27, wherein the first end is configured to removably couple to an end of the housing facing away from the ear canal when the housing is placed in the ear canal.

29. The hearing aid according to claim 17, wherein the battery door comprises a snap fit coupling.

* * * * *

UNITED STATES PATENT AND TRADEMARK OFFICE

CERTIFICATE OF CORRECTION

PATENT NO. : 8,331,593 B2
APPLICATION NO. : 12/278241
DATED : December 11, 2012
INVENTOR(S) : Slemming et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 623 days.

Signed and Sealed this
Twenty-ninth Day of July, 2014

Michelle K. Lee

Michelle K. Lee
*Deputy Director of the United States Patent and Trademark Office*